United States Patent [19]

Lee et al.

[11] 3,972,488

[45] Aug. 3, 1976

[54] EXPANDABLE CHUCK

[75] Inventors: Charles A. Lee; Warren R. Furbeck; Horace N. Kemp, all of Knoxville, Tenn.

[73] Assignee: International Paper Company, New York, N.Y.

[22] Filed: June 20, 1974

[21] Appl. No.: 481,327

Related U.S. Application Data

[62] Division of Ser. No. 114,994, Feb. 12, 1971, Pat. No. 3,841,620.

[52] U.S. Cl. ..... 242/72 B; 279/2 A

[51] Int. Cl.[2] ..... B65H 75/18

[58] Field of Search ..... 242/72 B; 279/2 R, 2 A; 269/48.1

[56] References Cited

UNITED STATES PATENTS

| | | | |
|---|---|---|---|
| 2,289,453 | 7/1942 | Randall | 242/72 B |
| 2,583,117 | 1/1952 | Piperoux et al. | 242/72 B |
| 2,876,961 | 3/1959 | Cole et al. | 242/72 B |
| 3,458,150 | 7/1969 | Cowan | 242/72 B |
| 3,510,082 | 5/1970 | Sexton et al. | 242/68.2 |

*Primary Examiner*—Leonard D. Christian

*Attorney, Agent, or Firm*—Robert R. Jackson; Charles B. Smith

[57] ABSTRACT

An expandable chuck for rotatably supporting a longitudinal roll, such as a tissue supply roll for a folding machine, having a hollow cylindrical core. Pneumatically inflatable tube members are mounted on spaced wheel members, which are in turn mounted on a cylindrical sleeve rotatably mounted on a support shaft. The tube members are pneumatically interconnected and the chuck is fully controllable from either end for insertion in or removal from the core of a roll by valve and vent means adjacent each end of the chuck.

4 Claims, 2 Drawing Figures

EXPANDABLE CHUCK

This is a division of application Ser. No. 114,994, filed Feb. 12, 1971, now U.S. Pat. No. 3,841,620.

BACKGROUND OF THE INVENTION

This invention relates to a pneumatically inflatable chuck or core assembly for rotatably supporting a longitudinal roll having a hollow cylindrical core.

The invention will be illustrated in its application to supporting tissue supply rolls for web or tissue folding machines. A tissue folding machine for use with the expandable chuck of this invention is described in detail in the above-mentioned application Ser. No. 114,994, now U.S. Pat. No. 3,841,620, of which this application is a division, and which is incorporated herein by reference. Accordingly, the tissue folding machine will be described only briefly and partially herein and reference to U.S. Pat. No. 3,841,620 will be necessary for a complete description of the machine.

There has been developed over the years a number of tissue interfolding machines. Representative machines of this type are disclosed, for example, in U.S. Pat. No. 2,642,279 granted June 15, 1953; U.S. Pat. No. 3,285,599 granted Nov. 15, 1966, U.S. Pat. No. 3,472,504 granted Oct. 14, 1969, and U.S. Pat. No. 3,542,356, granted Nov. 24, 1970. As will be understood, consumer size boxes of tissue commmonly contain 100 or more separate sheets in short lengths cut from a long stack. The stack is assembled by bringing together a corresponding number of tissue webs from separate supply rolls. As the webs are assembled in the stack, they are interfolded by a series of folding devices to produce one or more longitudinal folds on each web. The assembled stack is cut off into convenient lengths which are then packaged in wrappers or paperboard boxes for use by the consumer.

Among the difficulties exhibited by many prior interfolding machines resulted from the core assemblies used within each supply roll to facilitate the handling of the roll and its positioning on the machine. When a given roll exhausted its supply of tissue, for example, the spent core was manually removed from the machine, and the handling assembly within the core was detached in a more or less haphazard manner. The time required to remove the core, detach the handling assembly, insert the assembly in a fresh roll and position the fresh roll on the machine was excessive and resulted in unnecessary delays in the tissue folding operation.

SUMMARY OF INVENTION

In accordance with the invention, the cores for the supply rolls of a tissue folding machine or the like are provided with core assemblies which may be readily expanded and contracted from one end of the core. The assemblies are readily inserted in and withdrawn from the cores in a rapid and straightforward manner.

The expandable chuck or core assembly of this invention includes pneumatically inflatable tube members mounted on spaced wheel members. The wheel members are mounted on a cylindrical sleeve which is rotatably mounted on a support shaft. The tube members are pneumatically interconnected, as by a pneumatic tube running inside the cylindrical sleeve. Valve means are associated with each tube member. Each valve is accessible from the end of the chuck adjacent the associated tube member and permits both of the tube members to be pneumatically inflated in cooperation with the pneumatic interconnection between the tube members. Vent means may also be associated with each tube member and accessible from the end of the chuck adjacent the associated tube member to permit both of the tube members to be pneumatically deflated in cooperation with the pneumatic interconnection between the tube members. The tube members have an outer circumference measured concentric with the wheel members when not inflated which is less than the inner circumference of the core of the roll to be supported so that the chuck can be longitudinally inserted in or removed from the core when not inflated. When the chuck is inserted in the core and the tube members are inflated, the tube members expand radially outward to engage the inner surface of the core. The chuck is fully controllable from either end by virtue of the valve and vent provided at each end and the pneumatic interconnection between the tube members.

The present invention, will be understood more clearly and fully from the following description of certain preferred embodiments, when read with reference to the accompanying drawings.

DESCRIPTION OF CERTAIN PREFERRED EMBODIMENTS

Figure 2:
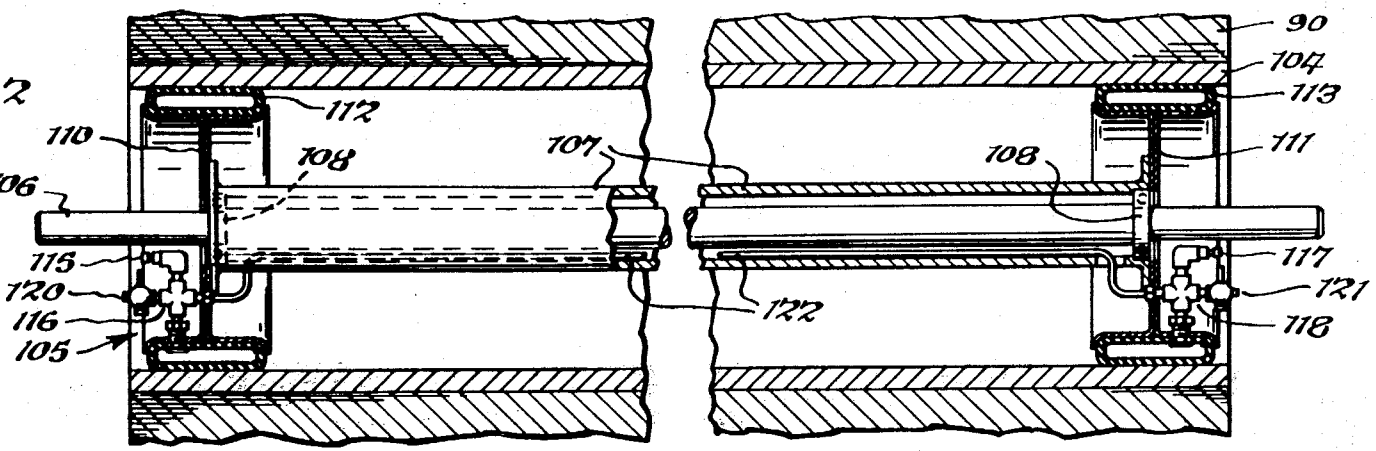
FIG. 2 is a vertical sectional view, partly broken away, of a tissue supply roll for the machine having an expandable core assembly, taken along the line 2—2 in FIG. 1.

As will be understood, the process of producing facial tissues includes the drawing together and folding into a continuous stack many tissue webs from a long line of tissue supply rolls. The stack is cut off into convenient lengths which are then packaged in wrappers or paperboard boxes which go to the consumer.

In the tissue folding machine illustrated in the drawings for use with the expandable chuck of this invention, the supply rolls are supported about fixed axes, and the webs are fed through a series of folding devices onto a stack which is moved relative to the supply rolls. In other tissue folding machines suitable for use with the expandable chuck of the invention, however, the supply rolls may be supported about axes which travel in a closed path countercurrent to the direction of movement of the stack, so that the relative movement of the webs and the supply rolls is the resultant of the combined movement. These latter machines are substantially shorter than the illustrated version and are of particular utility in cases where space is at a premium. For a more detailed description of the countercurrent movement of the supply rolls and the webs, reference may be had to U.S. Pat. Nos. 3,285,599 and 3,472,504 identified above.

Figure 1:
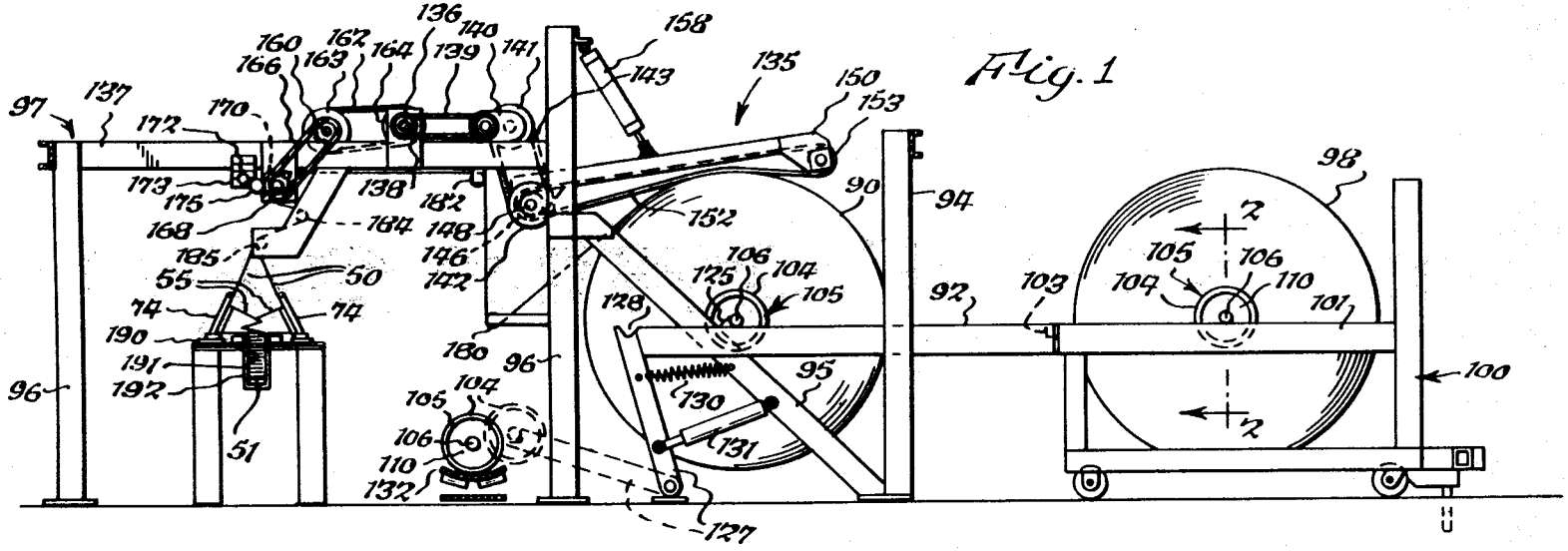
FIG. 1 is an end elevational view of a machine for interfolding a series of webs, with certain parts omitted and others shown in section.

As mentioned above, the tissue folding machine illustrated herein as suitable for use with the expandable chuck of this invention is described in detail in U.S. Pat. No. 3,841,620. With reference to FIG. 1 herein, this machine may be briefly described as follows: Webs are supplied from a plurality of adjacent supply rolls 90. Each web is slit longitudinally to the width required for finished tissues by disks 175 in cooperation with anvil roller 170. The slit webs 50 are fed to guide bars 74 and then to folding devices 55 on alternate sides of interfolded tissue stack 51 which is moving continuously on a conveyor mechanism in a direction perpendicular to the plane of the paper in FIG. 1. Each slit web 50 is interfolded into stack 51 in turn by the folding device 55 to which it is fed. When the required number of slit webs has been interfolded in stack 51, the completed stack is cut off into convenient lengths which are then packaged in wrappers or paperboard boxes which go to the consumer.

The expandable chuck or core assembly of this invention will now be described in detail, together with the elements in the immediate environment thereof in the tissue folding machine described above as an illustrative application of the invention.

THE MACHINE SUPPLY ROLLS AND CORE ASSEMBLIES

Referring to FIG. 1, the tissue or other sheet material from which the webs 50 are formed is fed to the various folding devices 55 from a series of supply rolls 90. One of the rolls 90 is provided for each group of four folding devices 55, and the material from each roll is slit, in a manner to be more fully described hereinafter, into four separate webs which are led to the individual folding devices.

Each of the supply rolls 90 is supported between a pair of horizontal beams 92. The beams 92 are mounted intermediate their ends on upright columns 94 and angularly disposed braces 95. The braces 95 extend from the lower ends of the columns 94 to a group of posts 96 which form portions of the frame 97 of the machine.

A back-up roll 98 is disposed immediately adjacent the supply roll 90 in position to be moved to an operative location on the machine when the material on the supply roll is exhausted. The back-up roll 98 is carried by a cart 100 having two horizontal beams 101 which are arranged to mate with the corresponding beams 92 on the machine. The beams 101 are each provided with a tongue 103 which abuts the adjacent beam 92 to locate the cart 100 in position.

The supply rolls 90 and the back-up rolls 98 include the usual paperboard cores 104. Removably mounted within each core is an expandable core assembly or chuck 105. As best shown in FIG. 2, each of the chucks 105 includes a central shaft 106 surrounded by a sleeve 107 which is rotatable with respect to the shaft. The sleeve 107 is provided with bearings 108 which serve to maintain the sleeve in spaced relationship with the shaft 106.

Affixed to the opposite ends of the sleeve 107 are generally disk-shaped wheels 110 and 111. Inflatable tubes 112 and 113 of rubber or other resilient material are respectively mounted on the wheels 110 and 111. The tube 112 communicates with a conventional air inlet 115 through a four-way connection 116, and the tube 113 similarly communicates with an air inlet 117 through a four-way connection 118. The inlets 115 and 117 are disposed at opposite ends of the chuck 105 in locations which are readily accessible to a suitable air hose (not shown). The connections 116 and 118 are provided with normally closed vent valves 120 and 121, respectively. These valves are located immediately adjacent the corresponding inlet 115 and 117. The connections 116 and 118 communicate with each other through a conduit 122 which is located within the rotatable sleeve 107.

The chuck 105 is manually inserted into one end of the core 104 in a deflated condition and may be controlled entirely from that end of the core. When the chuck 105 is in position, air is supplied to the tubes 112 and 113 through one of the inlets 115 or 117. Upon the admission of air into the inlet 115, for example, the air flows through the connection 116 to the tube 112 and also along the conduit 122 and the connection 118 to the tube 113. As the tubes 112 and 113 are inflated, they bear against the inner cylindrical surface of the core 104 to rigidly hold the tubes, the wheels 110 and 111, and the sleeve 107 within the core and to maintain the shaft 106 in coaxial relationship therewith. The shaft 106 is free to rotate relative to the core 104 and the surrounding roll, however, to facilitate the feeding of the material on the roll to the machine.

To remove the chuck 105 from the core 104, either of the vent valves 120 or 121 is actuated to release the air within the tubes 112 and 113. For example, upon the opening of the valve 120 at the left end of the chuck 105, as viewed in FIG. 2, the air within the tube 112 is exhausted through the connection 116 and the valve 120, while the air within the tube 113 is exhausted through the connection 118, the conduit 122, the connection 116 and the valve. Upon the deflation of the tubes 112 and 113, the chuck 105 is manually pulled from one end of the core. The arrangement is such that both the inflation and deflation of the tubes 112 and 113, as well as the insertion and removal of the chuck 105, may be handled from the same end of the core, and there is no need for the operator to move around the roll from one end of the core to the other in order to perform these operations.

The chuck shafts 106 for the supply rolls 90 rest on the horizontal beams 92, where they are located in position by a series of stops 125. The stops 125 are affixed to the beams intermediate the upstanding columns 94 and the inner ends of the beams.

Pivotally supported beneath the inner ends of each of the beams 92 is an angularly disposed arm 127. In its normal position (the position shown in full lines in FIG. 1), the upper end of the arm 127 abuts the inner end of the corresponding beam, and the arm forms an acute angle with respect to the horizontal which preferably is not greater than about 80° and illustratively is about 75°. The arm is movable from this position to the substantially horizontal position shown in dotted lines. The upper end of the arm is provided with a notch 128. A coil spring 130 and a shock absorber 131 are interposed between each arm and the adjacent brace 95.

When the tissue on the supply roll 90 becomes exhausted, the core 104 and the chuck 105 therein are moved over the stops 125 and are rolled to the inner ends of the horizontal beams 92. The chuck shaft 106 is received within the notches 128 on the pivotally mounted arms 127. The angular disposition of the arms 127 is such that the weight of the core 104 and the chuck 105 causes the arms to automatically move from their full line position to the position shown in dotted lines. The movement of the arms 127 is resisted by the springs 130 and the shock absorbers 131, with the result that the arms pivot smoothly to their dotted line position.

As the arms 127 reach their new position, the core 104 and the chuck 105 roll off the outer ends of the arms onto a belt-type conveyor 132. The coil springs 130 thereupon return the arms 127 to their initial position in contact with the beams 92. The conveyor 132 extends from one end of the machine to the other in a direction parallel to the direction of the tissue stack 51 and is effective to carry the spent cores to a central location at one end of the machine. The chucks 105 within the cores are then removed by actuating either of the vent valves 120, 121 (FIG. 2), and the chuck is inserted into the core for a fresh roll in the manner described heretofore.

THE ROLL DRIVE MECHANISMS

Each of the supply rolls 90 is independently driven by a drive mechanism indicated generally at 135. The mechanisms 135 are controlled by a common shaft 136 rotatably mounted on cross ties 137 which form portions of the main frame 97 of the machine. A series of sprockets 138 is affixed to the shaft 136, the number of sprockets corresponding to the number of rolls to be driven. Each of the sprockets 138 is connected by a drive chain 139 to a rotation reversing box 140, and the box 140 in turn drives a variable speed pulley 141 which is adjustable to change the speed of the roll drive. The pulley 141 is connected to a second pulley 142 by a belt 143. The box 140 and the pulley 141 are supported by the cross tie 137, while the pulley 142 is disposed immediately beneath the cross tie adjacent the upstanding post 96.

An electrically controlled clutch interconnects the pulley 142 and a coaxial pulley 146. The pulley 146 is mounted on a shaft 148 for rotation about a fixed axis. Pivotally connected to the shaft 148 is one end of a generally horizontal frame 150 which extends outwardly over the corresponding supply roll 90. A drive belt 152 extends around the pulley 146 and a second pulley 153 rotatably carried at the outer end of the frame 150.

The drive shaft 136 is continuously rotated in a counterclockwise direction, as viewed in FIG. 1, by a variable speed drive connected to an electric motor. As the shaft 136 rotates, the sprocket 138 and the chain 139 likewise are driven in a counterclockwise direction, and the direction of rotation is reversed by the box 140 to produce clockwise movement of the pulleys 141, 142, 146 and 153. The drive belt 152 similarly rotates in a clockwise direction, and the lower surface of the belt bears against the periphery of the roll 90 to continuously rotate the roll counterclockwise and thus feed the sheet material on the roll to the machine. In the event of a break in the material on one of the rolls, a limit switch (not visible in the drawings) may be provided to deenergize the corresponding clutch and thus interrupt the drive for that roll.

The weight of the frame 150 on the supply roll 90 is counterbalanced by a pneumatic cylinder 158 connected between the frame and the upper portion of the post 96. As the diameter of the supply roll 90 decreases during the withdrawal of the sheet material, the frame 150 pivots about the axis of of the shaft 148 to maintain the belt 152 in driving contact with the periphery of the roll. When the supply of material on the roll is exhausted, the frame 150 is moved to its uppermost position by the cylinder 158.

The arrangement is such that the drive mechanism 135 for each of the supply rolls 90 maintains the peripheral speed of the roll substantially constant irrespective of the roll's diameter. The roll speed is synchronized with the linear speed of the stack of webs and with the speed of the tissue slitting assemblies in a manner that will become more fully apparent hereinafter.

THE TISSUE SLITTING ASSEMBLIES

Mounted on every third cross tie 137 is a jack shaft 160. The shafts 160 are in coaxial relationship with each other and extend in a direction parallel to the direction of movement of the tissue stack 51. Each shaft is continuously rotated in a counterclockwise direction, as viewed in FIG. 1, by the main drive shaft 136. The shafts 136 and 160 are interconnected by a belt 162, a variable speed pulley 163 and a pulley 164.

A sprocket is carried by each of the jack shafts 160. The sprocket drives a chain 166 which extends around a second sprocket on an anvil shaft 168. One of the shafts 168 is provided for each jack shaft 160, and the shafts 168 are journaled in suitable bearings immediately beneath the cross ties 137. Each of the shafts 168 extends between three of the ties 137, there being one shaft for every three supply rolls 90 on the machine. Three anvil rolers 170 are affixed to each shaft 168, with one roller being provided between each pair of adjacent ties 137. There is thus one of the rollers 170 for each of the supply rolls 90.

Carried by the cross ties 137 immediately adjacent the anvil shafts 168 is a slitter shaft 172. The shaft 172 is supported by appropriate pillow blocks 173 affixed to each cross tie, and the shaft extends in a direction parallel to the shafts 160 and 168 and the stack 51. Successive groups of three slitting disks 175 are affixed at intervals along the shaft 172. Each of these groups is disposed between adjacent cross ties 137 such that the disks bear against the corresponding anvil roller 170.

The tissue or other sheet material on each supply roll 90 is led from the roll around a direction changing roll 180. The roll 180 is supported adjacent the post 96 and directs the tissue upwardly toward the cross ties 137. The tissue then passes over a bowed rod and around a roller 182. The bowed rod has a smoothing effect as the tissue moves thereover.

The incoming tissue then moves around the anvil roller 170. The roller 170 is continuously rotated in a counterclockwise direction, as viewed in FIG. 1, to provide an additional independent drive for the tissue. The rate of feed is adjustable by controlling the speed of the variable speed pulleys 163. The three disks 175 adjacent the roller 170 serve to slit the tissue into four equal-width webs 50. The webs thereupon move around a bowed smoothing roller 184 and an additional roller 185 prior to being received by the individual guide bars 74 adjacent the folding devices 55.

It will thus be apparent that the sheet material from each of the supply rolls 90 is divided into four separate webs by the slitting assembly including the slitting disks 175, and the cooperating anvil roller 170. The number of supply rolls on the machine is only one-fourth the number of webs. With this arrangement, the monitoring and replacement of the rolls is greatly faciliated.

THE STACK CONVEYOR MECHANISM

The various folding devices 55 and the adjacent guide bars 74 are mounted in spaced relationship with each other on a longitudinal table 190. Table 190 includes a centrally located longitudinal opening 191 which is provided with a series of depending U-shaped members 192. The legs of each of the members 192 are spaced by a distance approximately equal to the width of the tissue stack 51. An elongated plate extends along the length of the stack between the legs of the members 192, and the plate and the legs serve to partially confine the interfolded webs in the stack as they move along their feed path. The plate is disposed in a substantially horizontal plane but is provided with a slight downward slope toward the outfeed end of the machine to accomodate the increasing thickness of the stack as additional webs are interfolded therein.

The upper reach of a conveyor belt (not shown) is arrange to ride on the plate between the legs of the U-shaped members 192. At the outfeed of the machine the finished stack of webs is cut off and packaged as mentioned above.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention.

What is claimed is:

1. An expandable chuck for rotatably supporting a longitudinal roll having a hollow cylindrical core when inserted in said core and expanded, and being readily inserted in or removed from said core when not expanded, comprising:

a longitudinal shaft; for supporting said chuck a cylindrical sleeve concentric with said shaft and rotatably mounted on said shaft intermediate the ends thereof;

first and second wheel members concentric with said sleeve and fixedly mounted thereon, said wheel members being spaced apart on said sleeve by a distance less than the length of the core of the roll to be supported;

first and second pneumatically inflatable tube members respectively concentric with said first and second wheel members and fixedly mounted thereon, each of said tube members having an outer circumference measured concentric with the associated wheel member when not inflated which is substantially less than the inner circumference of the core of the roll to be supported so that said chuck can be longitudinally inserted in or removed from said core when not inflated, and each of said tube members expanding radially outward of the associated wheel member to engage the inner surface of the core of the roll to be supported when inserted in said core and pneumatically inflated;

means for pneumatically interconnecting said first and second tube members; and first and second valve means respectively associated with said first and second tube members and each accessible from the end of said expandable chuck adjacent the associated tube member when said chuck is inserted in the core of a roll to be supported, each of said valve means permitting both of said tube members to be pneumatically inflated in cooperation with said means for pneumatically interconnecting.

2. The expandable chuck defined in claim 1 wherein each of said valve means is normally closed.

3. The expandable chuck defined in claim 1 further comprising first and second controllable vent means respectively associated with said first and second tube members and each accessible from the end of said expandable chuck adjacent the associated tube member when said chuck is inserted in the core of a roll to be supported, each of said vent means permitting both of said tube members to be pneumatically deflated in cooperation with said means for pneumatically interconnecting.

4. The expandable chuck defined in claim 1 wherein said means for pneumatically interconnecting said first and second tube members includes a pneumatic tube running inside said sleeve from a point adjacent said first wheel member to a point adjacent said second wheel member.

* * * * *